United States Patent [19]

Shell

[11] Patent Number: 5,066,189

[45] Date of Patent: Nov. 19, 1991

[54] METHOD AND APPARATUS FOR HANDLING DISCRETE CARGO UNITS

[75] Inventor: Melvin E. Shell, Stephenville, Tex.

[73] Assignee: Shell Material Handling Systems, Inc., Stephenville, Tex.

[21] Appl. No.: 562,196

[22] Filed: Aug. 3, 1990

[51] Int. Cl.[5] ..... B66F 9/00

[52] U.S. Cl. ..... 414/416; 294/81.81; 294/88; 294/111; 414/626; 414/786

[58] Field of Search ..... 414/416, 624, 626, 785, 414/786, 665, 669, 672, 792.9, 796.9; 294/111, 38, 107, 81.61

[56] References Cited

U.S. PATENT DOCUMENTS

| | | | |
|---|---|---|---|
| 889,699 | 6/1908 | Lipscomb | 294/111 X |
| 2,457,135 | 12/1948 | Deiters | 414/626 |
| 2,641,769 | 6/1953 | Robinson | 294/111 X |
| 3,694,021 | 9/1972 | Mullen | 294/111 X |
| 3,727,968 | 4/1973 | Tsuchihashi et al. | 414/626 X |
| 4,592,692 | 6/1956 | Suizu et al. | 414/626 X |
| 4,927,318 | 5/1990 | Hayden et al. | 414/626 X |
| 4,957,320 | 9/1990 | Ulrich | 294/111 X |

FOREIGN PATENT DOCUMENTS

| | | | |
|---|---|---|---|
| 910410 | 3/1982 | U.S.S.R. | 294/111 |
| 1458224 | 2/1984 | U.S.S.R. | 294/111 |

*Primary Examiner*—David A. Bucci

*Attorney, Agent, or Firm*—Hubbard, Thurman, Tucker & Harris

[57] ABSTRACT

Two sets of fork units are dependingly supported from a suspension frame for engagement with a stack of cargo units, such as bags. The ends of the fork units are articulated so as to be positioned in either a perpendicular position relative to the upper portion of the fork unit or a longitudinally aligned position. End plates on the suspension frame cooperate with a special pallet to vertically and horizontally align the tip ends of the forks with openings in the special pallet.

20 Claims, 6 Drawing Sheets

METHOD AND APPARATUS FOR HANDLING DISCRETE CARGO UNITS

BACKGROUND OF THE INVENTION

1. FIELD OF THE INVENTION

The invention relates to cargo handling systems intended for use in loading stacks of cargo units from a dock into the cargo hold of a ship, truck or rail car.

2. SUMMARY OF THE PRIOR ART

There have been many devices and methods used in loading cargo into the holds of deep water vessels and other hollow vehicles. Loads consisting of discrete cargo units are often handled by means of a cargo net or by means of large portable containers. The handling of a collection of discrete cargo units has presented a particular problem because of the time-consuming manual labor required for loading and unloading the various transport apparatus used for conveying a bulk of such cargo units between a dock and a ship for example. Prior art methods and apparatuses for handling discrete cargo units generally involves the necessity of leaving bulky, space wasting wooden pallets beneath each stack of cargo units during such transfer. Such lost space can usually only be conserved by manually transferring from the pallet into the transport vehicle.

A good example of discrete cargo units is bags of granular or powdered materials, such as flour, grain or chemicals. Obviously, the bags must be gently handled in their transport into the hold of a vessel to avoid breakage of the bag and spillage of the contents. While a stack of such bags can be readily assembled on a pallet, a real problem arises when it is desired to transport the stack into the hold of the vessel without concurrently transporting the pallet. Thus, in the past, resort was generally made to the use of stevedores and cargo nets containing a stack of such bags. Stevedores must manually either remove the bags from the cargo net and stack them in the ship hold, or reassemble the bags on a pallet for transport to a remote section of the hold.

The same problem arises in the loading of discrete cargo units onto trucks and rail cars. Discrete cargo units are normally loaded into a truck in serial fashion, unless a pallet remains under the stack. Thus, serial loading requires an excessive amount of time and labor.

Accordingly, it is an object of this invention to provide an improved method and apparatus for loading discrete cargo units onto a ship, truck or other vehicle, without a pallet so that the vehicle is filled to capacity in a series of one or more simple mechanized loading maneuvers.

SUMMARY OF THE INVENTION

The apparatus embodying this invention comprises a generally rectangular suspension frame which is horizontally dimensioned to be approximately equal to the horizontal dimensions of a stack of discrete cargo units, such as bags, which are resting on a specially designed pallet on a loading dock and awaiting transfer to the hold of a ship or the interior of a truck or railway car. On two opposed sides of the rectangular suspension frame, a set of forks are respectively horizontally pivotally mounted. Such forks comprise a generally rigid upper portion which is pivotally mounted to the suspension frame and which can be moved from a depending vertically inclined position relative to the suspension frame to a generally vertical position wherein the upper portions of the fork will lie adjacent two opposed side walls of the stack of cargo units.

The individual forks of each set of forks are uniquely designed. The lower portion of each fork is articulated so as to be movable between a substantially longitudinally aligned position with respect to the rigid upper portions of the fork to a substantially perpendicular position relative to the upper portions of the fork. Such movement is provided by forming the medial portion of the fork by pivotally articulated subsections which have angularly disposed surfaces at each pivot point. When a tensile force is applied to the outermost one of the articulated subsections, the subsections will concurrently pivot about their interconnecting pivot points so that the outermost portion of the fork assume a position generally perpendicular to the upper portions of the fork. Thus, when the upper portions of each set of forks are subsequently pivoted relative to the suspension frame, the forks are moved inwardly beneath the openings provided in the pallet on which the stack of cargo units are resting and are thus in a position to engage the lowermost cargo units when a lifting force is applied to the suspension frame.

Prior to the movement of the forks into a load engaging position with respect to the cargo units, a pair of end plates, which are horizontally shiftably mounted to the remaining two sides of the suspension frame lying intermediate the two sets of forks, are shifted by hydraulic cylinders to a position where they are disposed adjacent the end faces of the stack of cargo units that are not engaged by the forks. The bottom portions of the end plates are each provided with horizontal axis rollers which engage horizontal positioning plates provided on each end of the specially designed pallet. Such engagement limits the downward movement of the suspension frame and, when the end plates are moved horizontally to abut the sides of the cargo stack, the two sets of forks are properly positioned to move into openings provided on the specal pallet to underlie the stack of cargo units. This prevents sidewise spilling of the cargo units from the stack during the lifting and placement maneuvers of the elevation frame.

Still another feature of this invention lies in the configuration of the outermost end portions of each fork. Each end portion comprises a plurality of pivotally articulated subsections, but these sections are pivotally connected in such manner that, in the load carrying position, adjacent surfaces of the pivotally interconnected subsections are in abutment. When, however, the upper portions of the forks are moved outwardly to disengage from the stack of cargo units at the new location, the articulated connections of the outermost portions of the forks permit the bending of such outermost portions to assume a generally arcuate configuration, permitting the outermost fork ends to be readily removed along a generally horizontal path relative to the cargo units so that no damage is imparted to the surfaces of the cargo units, particularly when such cargo units comprise cloth, paper or plastic bags.

It will therefore be apparent that this invention involves a novel method of handling discrete cargo units without a pallet by opposed sets of fork members, in that each fork member comprises a rigid upper portion for imparting movement between a load engaging and a load releasing position, plus two articulated lower fork portions. The application of tensile force to the intermediate articulated fork portion results in the bending of the intermediate articulated fork portion and causes the outermost fork portions to assume a substantially horizontal position relative to the upper fork portions during the engagement of the fork with the slots provided in a special pallet on which the stack of cargo units are resting. The outermost portions of the forks are also articulated into a number of subsections, but this articulation is in reverse to that of the intermediate articulated sections in that the outermost portions assume a rigid position when they engage with the bottom faces of the stack of cargo units through the application of a vertical force to the elevation platform. When, however, the load is deposited at its new location, the upward movement of the elevation platform, accompanied by the outward movement of the upper portions of the forks permits the articulated outermost portions of the fork to assume a generally arcuate configuration so that the extreme end portions of the fork move out of engagement with the load by following a substantially horizontal path as the lifting and inclination of the upper portions of the fork progresses. This horizontal path for the extreme end portions of the two opposed sets of forks results in a minimization of damage to the surfaces of the discrete cargo units contained in the stack.

Additional insurance against damaging the cargo units is provided by the cooperation of the end plates with the special pallet to accurately position the forks with respect to fork receiving openings provided in the special pallet.

Further objects and advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 2:
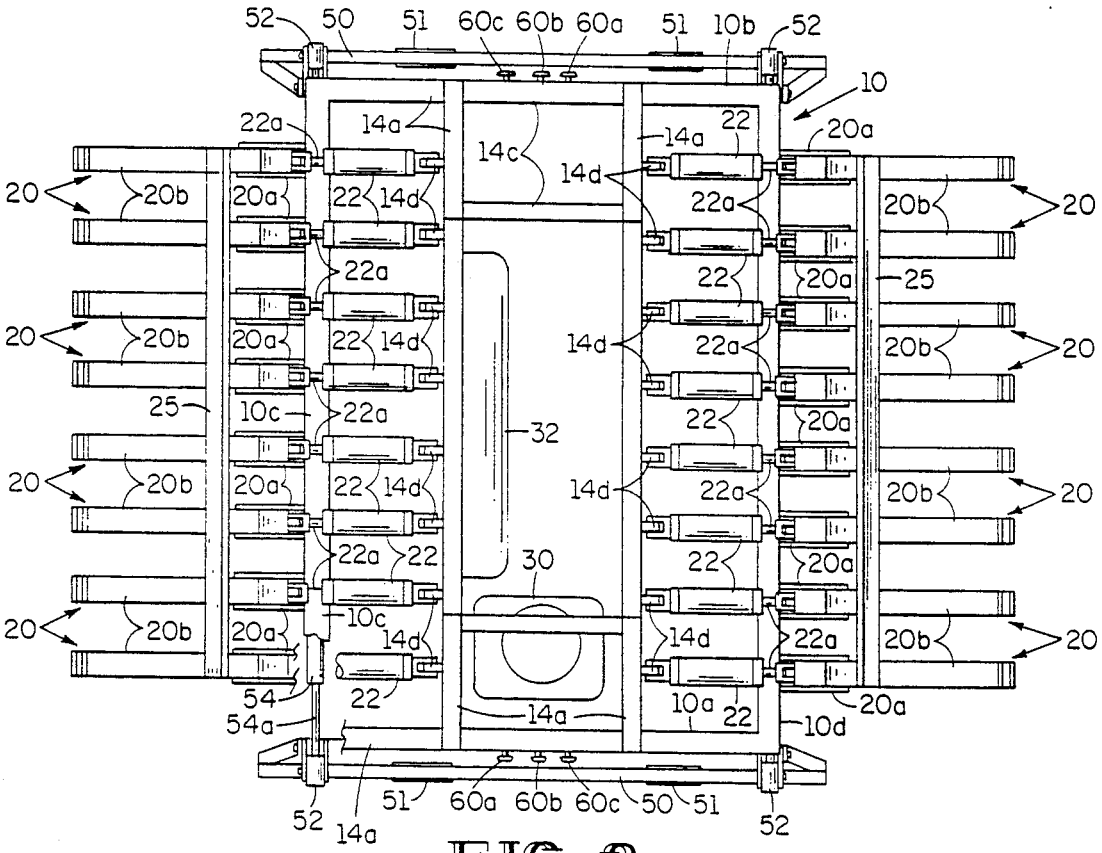
FIG. 2 is a top elevational view of FIG. 1, with hoisting blocks omitted for clarity.
Figure 1:
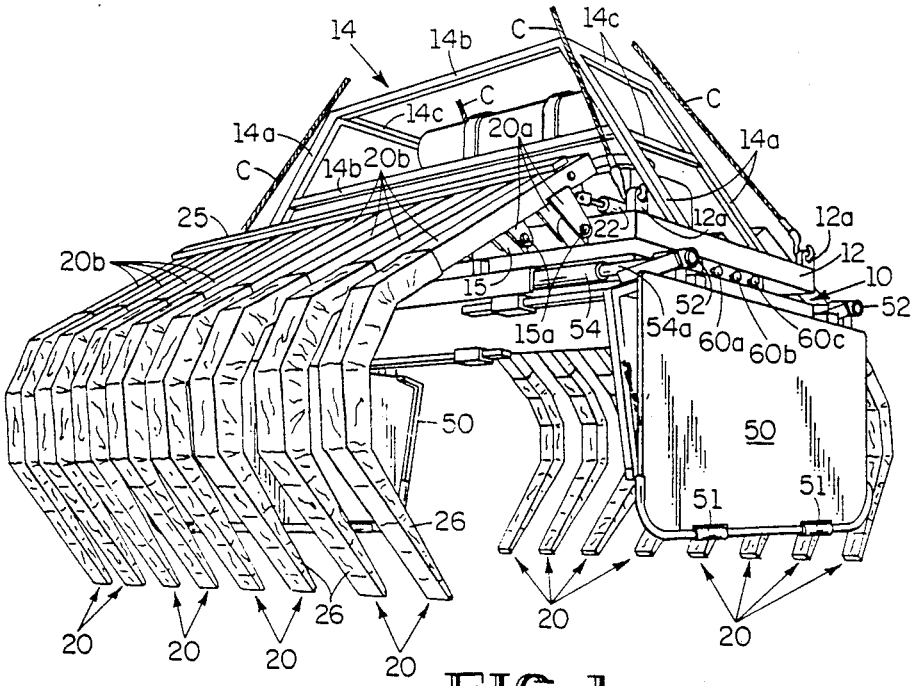
FIG. 1 is a perspective view of a cargo handling apparatus embodying this invention.

Referring to FIGS. 1 and 2 of the drawings, a fork-type cargo handling unit embodying this invention will be seen as comprising a generally rectangular frame structure 10 formed by welding short side frame elements 10*a* and 10*b* to long side frame elements 10*c* and 10*d*. A hoisting block 12 is welded or otherwise rigidly secured to the opposite ends of the long side frame elements 10*c* and 10*d* and provides the mounting for anchor hooks 12*a* by which the entire frame structure may be lifted by cables C depending from a crane structure (not shown).

To further rigidify the elevational frame 10, and to provide overhead protection to hydraulic pumps, motors and accessories that are mounted on the top of frame structure 10, as will be described, a protection frame 14 is formed of upwardly inclined elements 14*a* which are secured to four quadralaterally spaced points on the frame structure 10 and horizontal framing elements 14*b* and 14*c* which are welded to the inclined elements 14*a*.

At longitudinally spaced equal intervals along the length of the longitudinal frame elements 10*c* and 10*d* pivot mounting brackets 15 are welded and respectively provide horizontal pivotal mounting for the upper end portions of a plurality of lifting forks 20. The top ends 20*b* of each lifting fork 20 is of hollow, rectangular construction and mounting brackets 20*a* are formed thereon for cooperation with the pivot brackets 15 to which they are respectively horizontally pivotally mounted by pins 15*a*. As best shown in FIG. 2, the top ends of the upper fork portions 20*b* are respectively pivotally secured to the movable portion 22*a* of a piston and cylinder unit 22 which in turn is pivotally mounted on longitudinally spaced brackets 14*d* welded to longitudinally extending super frame elements 14*b*. Thus, application of fluid pressure to the cylinders 22 will cause each fork structure 20 to pivot relative to the suspension frame 10 and thus move from a load straddling position shown in FIG. 1 and schematically shown in FIG. 6, to a load engaging position schematically shown in FIG. 7.

Figure 10:
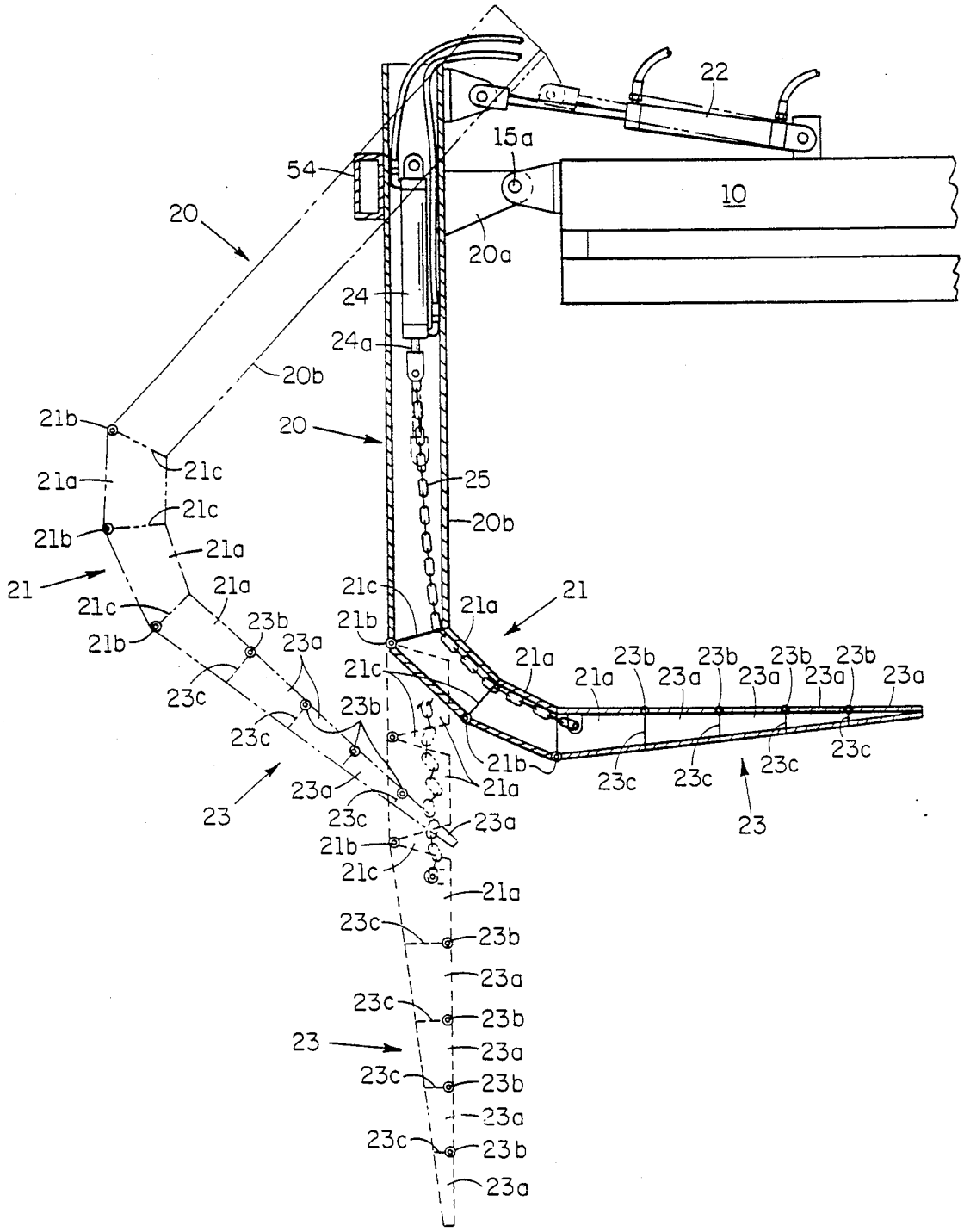
FIG. 10 is a schematic view, partly in section, illustrating the internal construction and movements of the fork elements of the apparatus of FIG. 1.

Referring now to the schematic view of FIG. 10, there will be noted that each fork 20 comprises an articulated medial section 21 which in turn is pivotally connected to an articulated outer end portion 23. The articulated medial section 21 is formed of a plurality of individual subsections 21*a*, each of which is pivotally secured by pivot pins 21*b* to the adjacent section. Pivot pins 21*b* are located along the outer or lower surface of fork section 21. Additionally, the medial articulated portion 21 is pivotally secured to the bottom end of the upper rigid portion 20*b* of the fork 20 by a pivot pin 21*b* and the lower end subsection 21*a* is pivoted to the first of the articulated subsections 23*a* of the articulated outer end portion 23 by a pivot pin 23*b*. Each of the articulated subsections 21*a* have abutting surfaces 21*c* when medial fork section 21 is disposed in a curved configuration indicated by the solid lines in FIG. 10; however, when the subsections 21*a* are pivoted relative to each other and the upper rigid portion 20*a* of the fork 20, the medial portion 21 assumes a longitudinal configuration as indicated by the dotted lines in FIG. 10.

Figure 8:
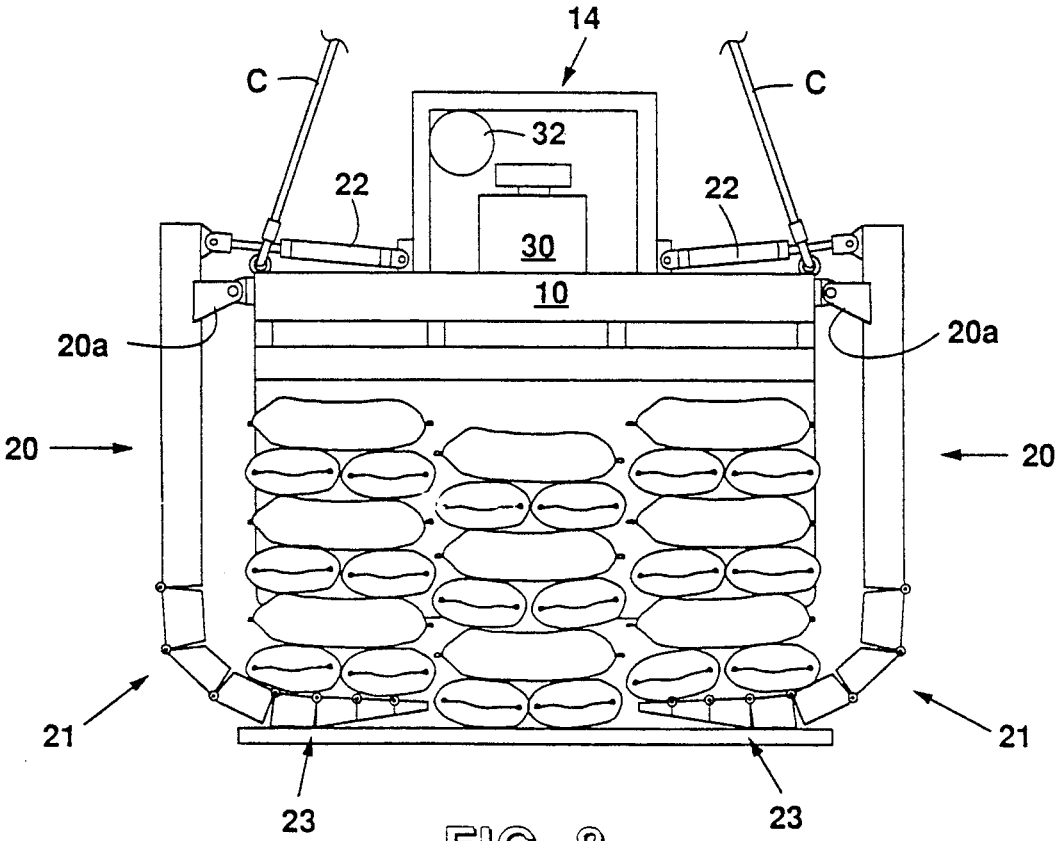
FIG. 8 is a schematic view illustrating the withdrawal of the fork elements from the stack of cargo units after the stack has been deposited in a new location.
Figure 9:
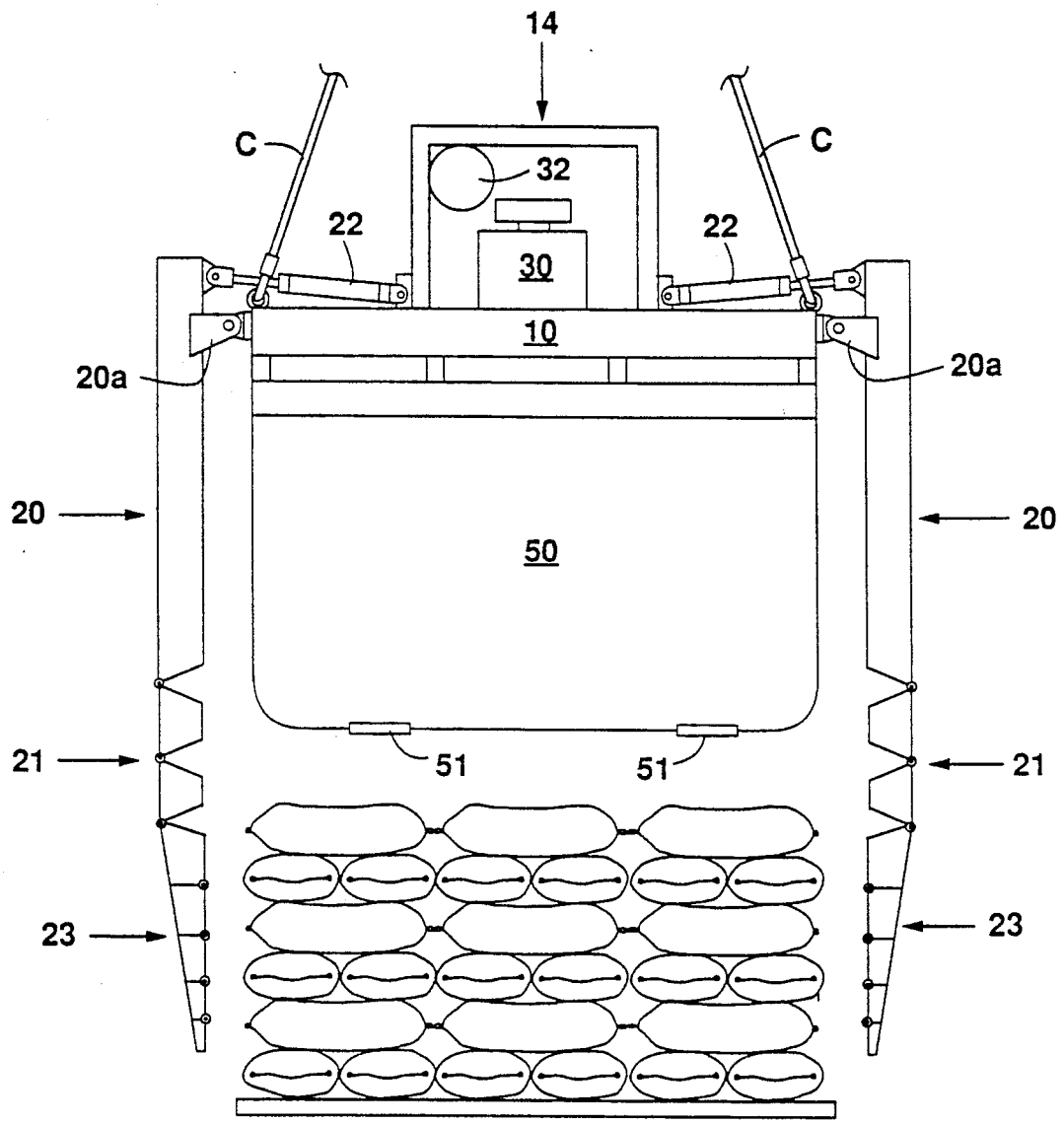
FIG. 9 is a schematic view illustrating the position of the fork elements of the cargo handling apparatus during removal from the stack of cargo units.

The outermost section 23 of each fork 20 has its pivot pins 23*b* disposed on the upper side of each subsection 23*a*. Abutting surfaces 23*c* secure the subsections 23 in a rigid straight line configuration substantially perpendicular to the rigid upper portion 20*a* of the fork 20, as illustrated by the solid lines in FIG. 10. However, the subsections 23*a* of the outermost fork portion 23 may pivot relative to each other in a direction opposite to the pivotal movement of the subsections 21*a* of the articulated medial portion 21 and thus such outer fork portion 23 may assume a curved configuration as schematically illustrated in FIG. 8 in order to facilitate the removal of the outermost fork portions 23 from the load being carried by the forks.

Figure 6:
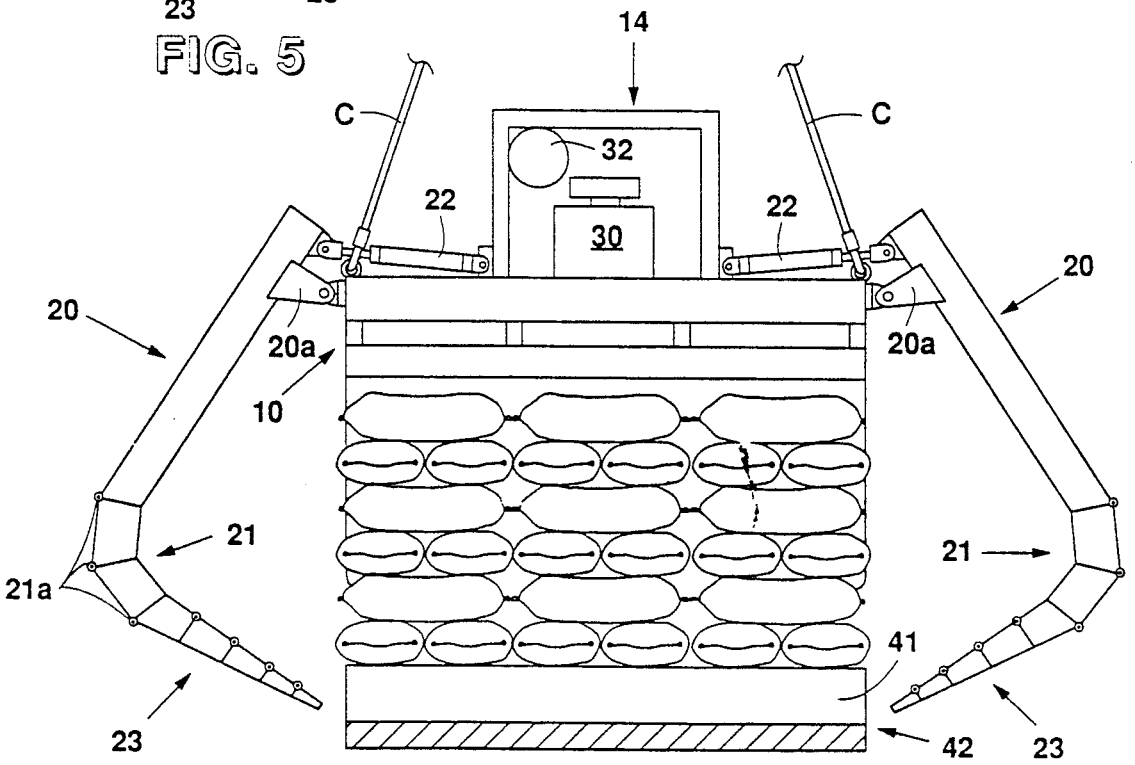
FIG. 6 is a schematic view illustrating the initial position assumed by the apparatus of FIG. 1 preliminary to picking up a stack of cargo units.

The articulated medial fork portion 21 is moved into its curved position through a tensile force applied by a fluid pressure cylinder 24 mounted within the upper rigid portion 20*b* of each fork 20. The movable member 24*a* of such cylinder is connected to a chain 25 which in turn is suitably connected to the outermost subsection 21*a* of the medial fork portion 21. The application of a tensile force to the chain 25 by the cylinder 24 will assure that the outermost fork portions 23 are disposed in a substantially perpendicular relationship to the upper rigid portion 20*b* of each fork 20 as illustrated by the solid lines in FIG. 10. Additionally, the application of pressured fluid to each cylinder 22 will pivot the upper portions 20*b* of each fork 20 about its pivotal mounting pins 15*a* to move the forks outwardly so as to straddle a load of stacked cargo units as schematically shown in FIG. 6 and by the left hand dotted lines in FIG. 10.

The cargo units may comprise rigid or non-rigid articles but the cargo handling apparatus embodying this invention is particularly well adapted to the handling of bag cargo wherein the material is contained within relatively fragile bags of paper, cloth or plastic and the bags are sufficiently flexible that they can readily shift and fall off the stack while being transported, unless they are properly retained in position.

Figure 4:
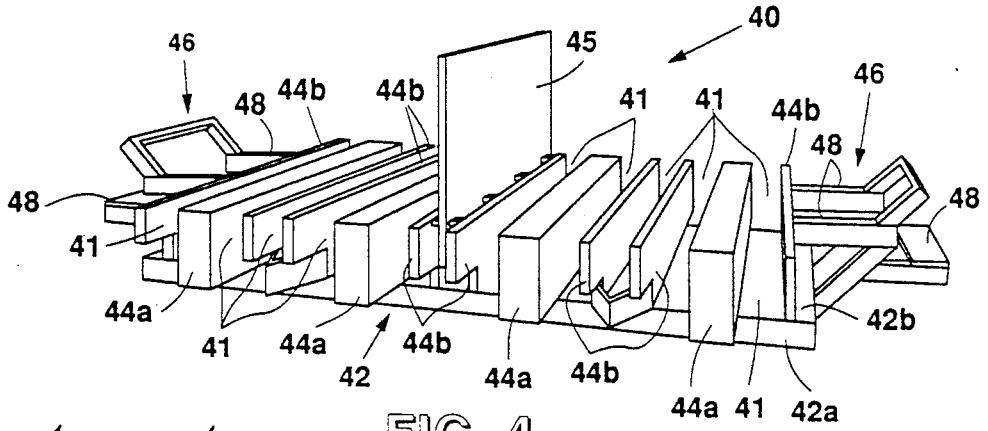
FIG. 4 is a perspective view of a special pallet employed with the apparatus of FIG. 1.

It is contemplated that the stack of cargo units would be initially disposed on special pallet 40 which is best shown in FIG. 4. Pallet 40 comprises a rectangular base frame 42 formed by welding longitudinal members 42*a* to transverse members 42*b*. Upstanding from the base frame is a plurality of spaced bag support members. Some of such support members, which will engage a medial portion of a bag, are of relatively greater width, as illustrated by the members 44*a*, than other support members 44*b*. If desired, a central upstanding dividing panel 45 may be provided to facilitate the uniform loading of the bottom layers of bags. Additionally, upwardly inclined stack end restaining elements 46 are welded to each longitudinal end of the pallet 40 to prevent movement of the bags off each longitudinal end of the stack.

Figure 5:
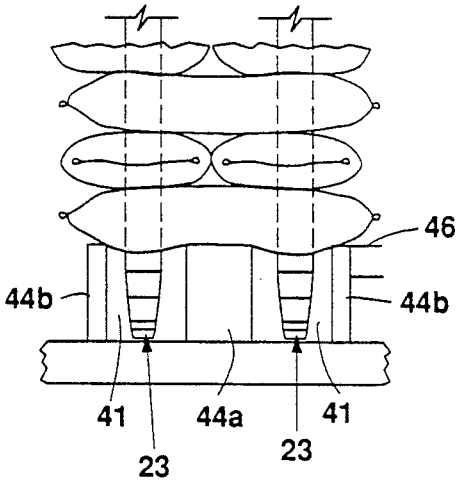
FIG. 5 is a partial vertical sectional view of the pallet of FIG. 4 showing the stacking of bag-type cargo units thereon.

It will thus be apparent that the upstanding bag support members provide horizontally extending channels 41 by which the outermost end portions 23 of the forks 20 may be inserted in underlying relationship to a medial portion of each bag in the bottom row, as schematically shown in FIG. 5. The bags are, of course, stacked with each layer being disposed at a 90° turned position relative to the adjacent layer, as shown in FIG. 5.

Figure 7:
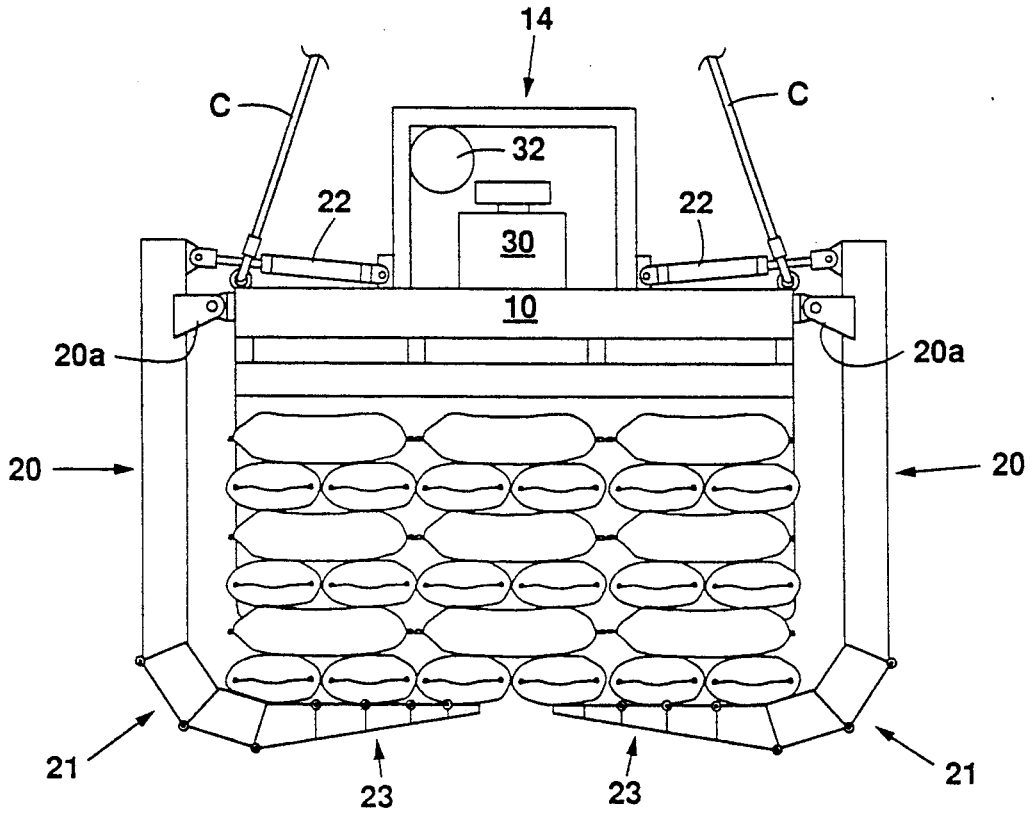
FIG. 7 is a schematic view illustrating the stack of cargo units being lifted by the apparatus of FIG. 1.

The fork insertion movement is, of course, accomplished by supplying pressured fluid to the cylinders 22 which pivot the upper rigid portions 20*a* of fork 20 to a generally vertical position, while the cylinders 24 are energized to effect the bending of the articulated medial portion 21 so that the outermost end portion 23 of each fork 20 is disposed in perpendicular relationship to the rigid upper portion 20*a*. This configuration is clearly shown by the solid lines of FIG. 10, as well as by the schematic view of FIG. 7 showing a stack of cargo units supported by the forks 20.

The special pallet 40 also performs a very desirable function in cooperation with a pair of end plates 50 which are mounted on the two sides of the suspension frame 10 intermediate the two sets of forks 20. End plates 50 are of generally rectangular configuration and conform in dimensions, particularly in height, to the unsupported side wall dimensions of the stack of cargo units. Each side panel or end plate 50 is mounted to frame 10 in a manner permitting limited horizontal shifting movement of the panels. Thus, as shown in FIG. 2, the panels 50 may be suspended from a pair of bushings 52 which in turn are secured to the ends of cylinder rods 54*a* of hydraulic cylinders 54 which are respectively welded to the side frames 10*c* and 10*d* of the suspension frame 10. When fluid pressure is applied to cylinders 54, the end plates 50 will be moved adjacent the stack and abut inclined restraining elements 46 on pallet 40. This movement will horizontally align the forks 20 with the pallet openings 41.

Horizontal axis rollers 51 may be mounted on the bottom edges of end plates 50 and engage horizontal platforms 48 provided on opposite longitudinal ends of pallet 40. Such engagement limits the downward movement of suspension platform 10, hence vertically aligns forks 20 with pallet openings 41. The time saved by the automatic alignment of the forks 20 by the cooperation of end plates 50 with special pallet 40 is another significant advantage of the invention.

When the end plates 50 are thus engaged with the pallet 40, fluid pressure applied to the cylinders 22 will cause the outer end portions 23 of forks 20 to enter pallet openings 41. Elevation of the suspension platform 10 will cause forks 20 to lift the stack of cargo units from pallet 40 to the ship hold or the bed of a railroad car or truck.

When the load is deposited in the desired location, cylinders 24 are activated to release the tensile force on the medial pivoted sections 21*a*. Concurrently, the suspension platform 10 is raised and the net effect is that the articulated outermost portions 23 of each fork 20 are removed in a substantially horizontal path from beneath the bags or other cargo units resting thereon (see FIG. 8). To protect the bags or cargo units from damage during such removal motion, each of the forks 20 preferably has its lower cargo engaging portions surrounded by a canvas sleeve 26 as shown in FIG. 1.

Figure 3:
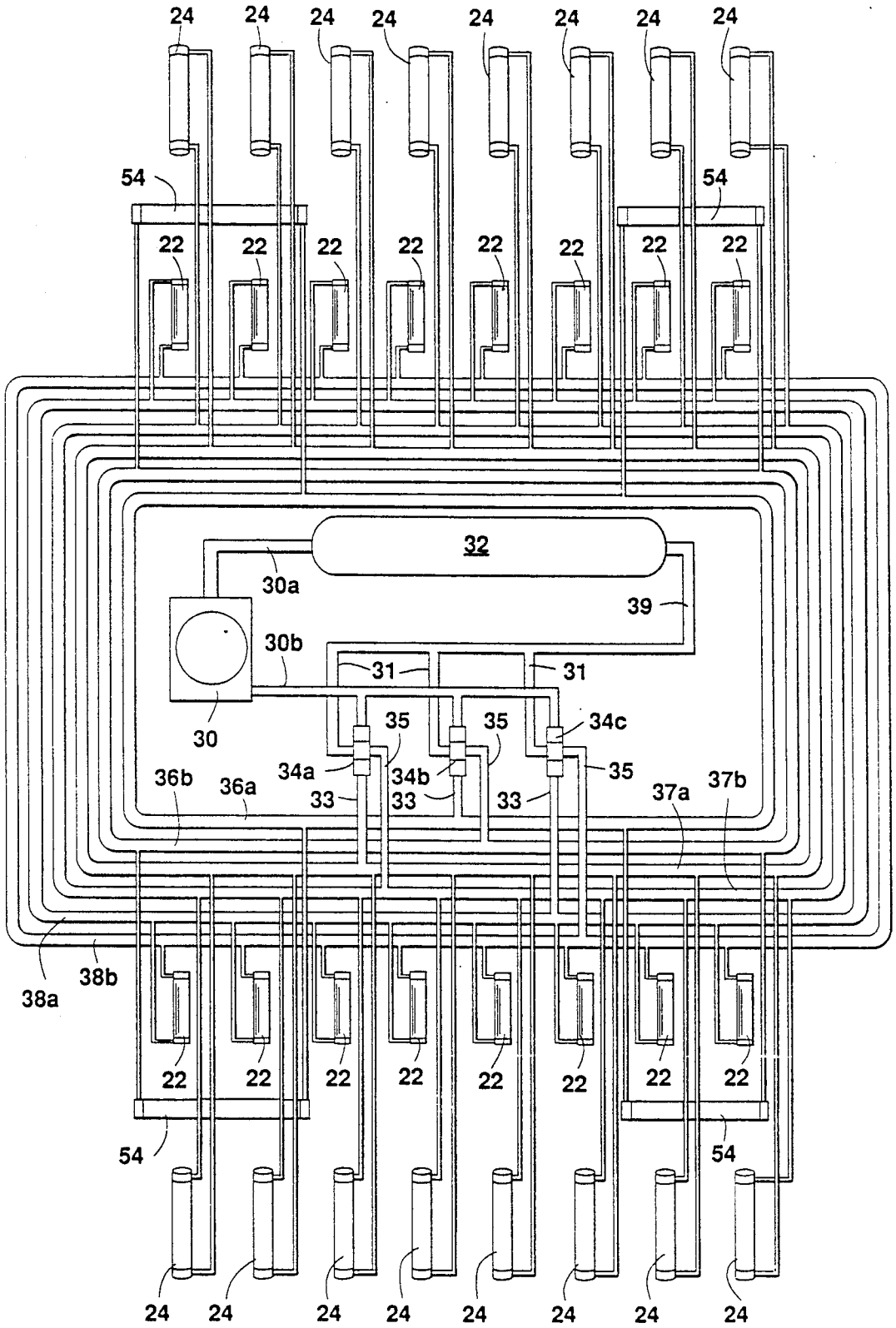
FIG. 3 is a schematic hydraulic circuit diagram for the apparatus of FIG. 1.

Referring now to FIG. 3, the hydraulic circuitry for operating the various cylinders heretofore referred to is schematically disclosed. Such circuitry, which is conventional, includes a motor driven pump 30 which has an inlet portion connected to a sump or accumulator 32 by pipe 30*a*. The outlet of pump 30 is connected by conduit 30*b* to three conventional electrically controlled valves 34*a*, 34*b* and 34*c* and then to the three sets of double acting cylinders 54, 24 and 22 incorporated in the cargo handling apparatus respectively through rectangular piping lines 36*a* and 36*b*, 37*a* and 37*b*, and 38*a* and 38*b*. In addition to supply conduit 30*b*, each valve has two pressure outlets 33 and 35 respectively connected to opposite ends of the respective set of cylinders and an outlet 31 connected to the sump 32 by a piping line 39. Thus, fluid is returned from the non-pressurized sides of all the cylinders by the respective valve 34*a*, 34*b* and 34*c* to sump 32.

Electrically controlled valves 34*a*, 34*b* and 34*c* may be conventionally operated by manually controlled switches indicated by buttons 60*a*, 60*b* and 60*c* in FIG. 1.

While theoretically, all of the forks 20 should be moved concurrently relative to the stack of cargo units, the plurality of hydraulic cylinders 22 may not necessarily operate exactly in synchronism. Hence, it is desirable to physically interconnect the rigid upper portions 20*a* of each of the forks 20 by a transverse bar 25 which is welded or otherwise rigidly secured to such upper fork end portions. The advantage of utilizing a plurality of individual cylinders lies in the fact that if only a single cylinder were employed for each set of forks, it would be relatively massive because of the total force required to be developed. Additionally, if such single cylinder failed in operation, the cargo handling apparatus would be inoperative. With the aforedescribed construction utilizing a plurality of relatively small cylinders, the size configuration and the fluid volume and pressure requirements are greatly reduced, while at the same time, the failure of one or more cylinders will not render the apparatus inoperative, since the other cylinders can take up the load dropped by the defective cylinders.

Those skilled in the art will realize that substitutions and modifications may be made in the described structure and method without departing from the scope and spirit of the appended claims.

What is claimed and desired to be secured by Letters Patent is:

1. A fork for handling a rectangular stack of cargo units without a pallet comprising:

a rectangular suspension frame having horizontal dimensions approximating those of the rectangular stack;

means on said suspension frame for attachment to crane cables for lowering and raising said suspension frame;

a plurality of forks;

each fork having a rigid upper portion and an articulated lower portion movable between a substantially 90° load carrying position relative to said upper portion and a substantially longitudinally aligned, load releasing position relative to said upper portion;

means spaced along two opposed sides of said suspension frame for horizontally pivotally mounting said upper portions of said forks, whereby one set of said forks is disposed along one side of said stack and a second set of said forks is disposed along the opposite side of said stack;

first power means for concurrently shifting said lower fork portions relative to said upper fork portions from said load releasing position to said load carrying position; and second power means for concurrently shifting said upper portions of said forks from an angularly inclined vertical position wherein said opposed sets of forks clear said stack, to a substantially vertical position wherein both sets of said lower fork portions move under said stack in their load carrying positions, whereby said stack may be lifted and moved to another location by said suspension frame.

2. The apparatus of claim 1 wherein said lower fork portion comprises:

a plurality of pivotally interconnected, longitudinal sections;

said sections having abutting, transverse surfaces when said lower fork portion is shifted to said load carrying position by said first power means; and said transverse surfaces being pivotally separated when a force exerted by said first power means is released.

3. The apparatus of claim 2 wherein said first power means comprises:

a fluid pressure operated cylinder mounted on said upper portion of each said fork and having a movable member; and tension force transmitting means connecting said movable member and an outermost longitudinal fork section, whereby tensile force supplied to said outermost longitudinal fork section pivots said lower fork section to said load carrying position.

4. The apparatus of claim 3 wherein each said rigid upper section of each said fork is of hollow configuration; and each said fluid pressure operated cylinder being mounted within said upper fork portion.

5. The apparatus of claim 3 wherein said outermost longitudinal fork section comprises:

a plurality of longitudinal, pivotally interconnected subsections;

said subsections having transverse surfaces abuttable to form a generally horizontal, rigid configuration when loaded by said stack but assuming a generally arcuate configuration when said suspension frame is elevated for removal from the stack, thereby permitting ready removal of said outermost longitudinal fork sections from under said stack.

6. The apparatus of claim 1 further comprising a transverse bar secured to said upper portions of each said set of forks, whereby all forks of a set are moved concurrently by said second power means.

7. The apparatus of claim 1, 2, 3, 4, 5, or 6 further comprising:

a pair of end plates dimensioned to substantially cover two sides of the stack intermediate fork engaged sides;

means for respectively horizontally shiftably mounting said end plates in depending relation to sides of said suspension frame intermediate said two sets of forks; and third power means for shifting said end plates between a horizontally spaced position relative to the stack to a substantial vertical position adjacent the sides of said stack intermediate said two sets of forks, thereby providing additional stability to said stack when engaged by said forks.

8. The apparatus of claim 1, 2, 3, 4, 5 or 6 further comprising:

a pallet having a plurality of spaced parallel load supporting members on which said stack of cargo units is initially formed;

the spaces between said load supporting members being dimensioned to receive the outermost portions of said two sets of forks;

a pair of end plates dimensioned to substantially cover two sides of the stack intermediate fork engaged sides;

means for respectively horizontally shiftably mounting said end plates in depending relation to said sides of said suspension frame intermediate said two sets of forks;

third power means for shifting said end plates between a horizontally spaced position relative to the stack to a substantial vertical position adjacent said sides of said stack intermediate said two sets of forks, thereby providing additional stability to said stack when engaged by said forks;

said pallet having projecting horizontal surfaces on two side respectively engagable by bottom ends of said end plates, thereby limiting downward movement of said suspension frame to vertically align said fork end portions with said pallet openings.

9. The apparatus of claim 1, 2, 3, 4, 5 or 6 further comprising:

a pallet having a plurality of spaced parallel load supporting members on which said stack of cargo units is initially formed;

the spaces between said load supporting members being dimensioned to receive the outermost portions of said two sets of forks;

a pair of end plates dimensioned to substantially cover two sides of the stack intermediate fork engaged sides;

means for respectively horizontally shiftably mounting said end plates in depending relation to sides of said suspension frame intermediate said two sets of forks;

third power means for shifting said end plates between a horizontally spaced position relative to the stack to a substantial vertical position adjacent the sides of said stack intermediate said two sets of forks, thereby providing additional stability to said stack -when engaged by said forks;

said pallet having projecting horizontal surfaces on two sides respectively engagable by bottom ends of said end plates, thereby limiting downward movement of said suspension frame to vertically align said fork end portions with said pallet openings; and said end plates also functioning to horizontally align said fork end portions with said pallet openings when horizontally moved by said third power means adjacent to said stack.

10. A fork for handling a rectangular stack of cargo units without a pallet comprising:

a rectangular suspension frame having horizontal dimensions approximating those of the rectangular stack;

means on said suspension frame for attachment to crane cables for lowering and raising said suspension frame;

a plurality of forks;

each fork having a rigid upper portion, an articulated medial portion, and an articulated outer end portion;

said articulated medial portion having a plurality of horizontally, pivotally connected first sections;

said first sections having abuttable adjacent surfaces permitting movement of said medial portion from a generally 90° arcuate loading configuration relative to said upper portion to a longitudinally aligned, load releasing configuration relative to said upper portion;

said articulated outer end portion having a plurality of horizontally, pivotally connected second sections;

said second sections having abuttable adjacent surfaces permitting movement of said outer end portion from a rigid perpendicular, load carrying position relative to said upper portion to a longitudinally aligned, load releasing position relative to said upper portion;

first power means for concurrently shifting said medial first sections to said loading configuration relative to said upper position; and second power means for concurrently shifting said upper portions of said forks from an angularly inclined, vertical position wherein said opposed sets of forks clear said stack, to a substantially vertical position wherein both sets of said outer end portions of said forks move under said stack in their load carrying positions, whereby said stack may be lifted and moved to another location by said suspension frame.

11. The apparatus of claim 10 wherein said first power means comprises:

a fluid pressure operated cylinder mounted on said upper portion of each said fork and having a movable member; and tension force transmitting means connecting said movable member and said outer fork end portion, whereby tensile force supplied to said outer fork end portion concurrently pivots each said second sections to said load carrying position.

12. The apparatus of claim 11 wherein each said rigid upper section of each said fork is of hollow configuration; and each said fluid pressure operated cylinder being mounted within each said upper fork portion.

13. The apparatus of claim 10 further comprising a transverse bar secured to said upper portions of each said set of forks, whereby all forks of a set are moved concurrently by said second power means.

14. The apparatus of claim 10, 11, 12 or 13 further comprising:

a pair of rectangular end plates dimensioned to substantially cover two sides of the stack intermediate fork engaged sides;

means for respectively horizontally shiftably mounting said end plates in depending relation to sides of said suspension frame intermediate said two sets of forks; and third power means for shifting said end plates between a horizontally spaced position relative to the stack to a position adjacent the sides of said stack intermediate said two sets of forks, thereby providing additional stability to said stack when engaged by said forks.

15. The apparatus of claim 10, 11, 12, or 13 further comprising a heavy fabric pouch contoured to surround said acticulated outer fork end section.

16. A method of transporting a generally rectangular stack of non-rigid cargo units resting on a pallet having a plurality of spaced, stack supporting surfaces separated by a plurality of fork openings, comprising the steps of:

1. providing a crane liftable rectangular platform of a horizontal size approximating said stack;
2. horizontally pivotally suspending from two opposed sides of said platform rigid upper portions of a plurality of fork units to form two sets of forks straddling said stack in an initial position;
3. providing an articulated medial section on each fork permitting an outer end portion of the fork to assume a loading position substantially perpendicular to said rigid upper fork portion or an unloading position longitudinally aligned with said rigid upper fork portion;
4. applying a tensile force to said medial section to move all said fork outer end portions to said loading position;
5. aligning said fork outer end portions with said pallet openings;
6. pivoting said rigid upper end portions of all said forks to move said outer end portions into said pallet openings to lie beneath said stack; and 7. elevating said platform to lift said stack off said pallet for transport by crane.

17. The method of claim 14 further comprising the steps of:

horizontally shiftably mounting on the other opposed sides of said platform a pair of depending end plates; and prior to engaging said stack by said fork units, moving said end plates into abutting engagement with two sides of said stack not engaged by said two sets of forks.

18. The method of claim 16 or 17 further comprising the steps of:

forming the outer end portion of each fork by horizontally pivotally connecting a plurality of subsections; and preventing relative downward movement of adjacent subsections while under load by said stack but permitting relative upward pivotal movement of adjacent subsections, thereby permitting substantially horizontal withdrawal of said outer fork end portions from said stack when deposited in a new location by release of said tensile force and by upward movement of said platform.

19. The method of claim 16 or 17 further comprising the steps of:

depositing the fork carried stack on a base surface at a new location; and elevating said platform to permit said articulated medial section to gradually assume said unloading position relative to said platform.

20. The method of claim 16 or 17 further comprising the steps of:

depositing the fork carried stack on a base suface at a new location;

releasing the tensile force on said medial section;

elevating said platform to permit said articulated medial section to gradually assume said unloading position relative to said platform;

forming the outer end portion of each fork by horizontally pivotally connecting a plurality of subsections; and preventing relative downward movement of adjacent subsections while under load by said stack but permitting relative upward pivotal movement of adjacent subsections, thereby permitting substantially horizontal withdrawal of said outer fork end portions from said stack when deposited in a new location by release of said tensile force and movement of said platform.

* * * * *